US007104541B2

(12) United States Patent
Green

(10) Patent No.: US 7,104,541 B2
(45) Date of Patent: Sep. 12, 2006

(54) STRATEGY CARD GAME

(76) Inventor: Christian H. Green, 3466 77th Ave. SE., Mercer Island, WA (US) 98040

( * ) Notice: Subject to any disclaimer, the term of this patent is extended or adjusted under 35 U.S.C. 154(b) by 0 days.

(21) Appl. No.: 10/788,794

(22) Filed: Feb. 27, 2004

(65) Prior Publication Data

US 2004/0188939 A1 Sep. 30, 2004

Related U.S. Application Data

(60) Provisional application No. 60/458,269, filed on Mar. 29, 2003.

(51) Int. Cl.
*A63F 9/34* (2006.01)

(52) U.S. Cl. ..... 273/267; 276/293; 276/295; 276/239

(58) Field of Classification Search ..... 273/271, 273/267, 275, 264, 276, 293, 239, 295
See application file for complete search history.

(56) References Cited

U.S. PATENT DOCUMENTS 4,436,309 A * 3/1984 Barlow et al. ..... 273/267
5,839,729 A * 11/1998 Watanabe ..... 273/276

OTHER PUBLICATIONS

"Kling Magnetic Card Game", U.S. Gaming Systems, Inc. 1992 catalog, p. 28.*

* cited by examiner

*Primary Examiner*—Benjamin Layno
(74) *Attorney, Agent, or Firm*—Christensen O'Connor Johnson Kindness PLLC

(57) ABSTRACT

A game kit includes a set of cards placeable on a magnetically attracting playing surface and a set of point markers. The game is expandable and can include multiple players. The players randomly select a playing surface and decide the order of playing the game. The game has a set of restrictions that guides the progress of the game. The game concludes when one player runs out point markers, there are no more cards to pick, or no more playing surface available.

6 Claims, 12 Drawing Sheets

STRATEGY CARD GAME

CROSS-REFERENCE TO RELATED APPLICATION

This application claims the benefit of U.S. Provisional Application No. 60/458,269, filed Mar. 29, 2003, entitled "Strategy Card Game Expanding Into a 3-D Puzzle," which is expressly incorporated herein by reference.

FIELD OF THE INVENTION

The present invention relates generally to games, and, more particularly, to playing activities engaged in for diversion and amusement that incorporate formulating strategies and solving puzzles.

BACKGROUND OF THE INVENTION

In recent years, there has been a resurgence of game playing among people. Two factors help the comeback of game playing—the preference of consumers to get entertainment in less expensive ways, and the desire of people to spend more time with family and friends. For example, parents like to have time together with children. Besides or instead of taking a long expensive trip to a remote place, parents are more likely to play games together with their children now and then. Games are thus a family affair. Board games, such as card games, have the appeal of great entertainment for a small price. They also have the element of human interaction that enables family and friends to mingle.

According to research data, the most popular board games are card games. As shown in FIG. 1A, a conventional card game 104 usually consists of cards that are marked with figures, numbers, or symbols. The corresponding game playing usually is about coordinating these figures, numbers, or symbols to reach a winning outcome. Image creation generally is not part of a card game. As a result, the game playing process generally does not involve artistic creation of images.

Puzzles 106 enjoy wide popularity as well. See FIG. 1B. Word puzzles are common scenes in newspapers and magazines. Jigsaw puzzles and 3-D puzzles mostly are about image making and shape formation. However, both the jigsaw puzzles and the 3-D puzzles usually focus on putting pieces together to recreate predetermined images and shapes. NO emphasis has been placed on the dynamic creation of random, artistic images. The processes are generally mechanical, hence weak on creativity and strategy as well.

Further, both the conventional card games 104 and puzzles 106 are generally restrictive. They put limits on where the games can be played and how many people may participate. In physical form, cards and puzzle pieces are generally made of paper, cardboard, or plastics. These materials cannot sustain good game play in adverse outdoor conditions that may include rain and wind. Hence, players usually need to move themselves indoors if they want to continue the game in inclement weather. Further, the playing surfaces generally have to be flat and horizontal.

Even more, both the conventional card games 104 and the puzzles 106 tend to separate the game playing experience from a player's immediate environment. For example, conventional card games or puzzles may require playing surfaces that have a certain size. Further, both the conventional card games and the conventional puzzles tend to predetermine the numbers of players per game. These restrictions put limits on how the consumers may entertain and socialize by playing a game.

Thus, there exists a need for a card game that avoid or reduce the problems discussed above.

SUMMARY OF THE INVENTION

In accordance with the present invention, a kit and a method for playing a strategy card game is provided. The kit form of the invention includes a game kit that comprises a set of cards selected from a group consisting of a play card, a pointer card, and a blocker card. Each card has a top layer and a bottom layer. The top layer has a design superimposed by a configuration. The bottom layer is magnetized. The game kit further includes a set of point markers. The configuration includes dotted lines. The play card includes dotted lines forming one or more open polygons. The pointer card includes dotted lines forming one or more closed polygons.

In accordance with further aspects of this invention, a method form of the invention includes a method of playing a strategy card game. The method includes selecting a playing surface formed from a magnetic element. The method further includes placing a card from a set of cards that is selected from a group consisting of a play card, a pointer card, and a blocker card. Each card has a top layer and a bottom layer. The top layer has a design superimposed by one or more lines with a pattern. The bottom layer is magnetized. The act of placing the card on the playing surface includes forming a closed polygon in which a point marker can fit. The act of placing the card on the playing surface further includes placing the card in a position selected from a group consisting of parallel and perpendicular so as to touch other cards in play. The act of placing the card includes refraining from overlapping the card by more than 50% of another card underneath. The act of placing the card includes avoiding overlapping a line that is a part of a formed polygon. The act of placing the card includes inhibiting the placement of the card to form a void showing through from any playing surface under the puzzle. The act of placing the card includes refraining from placing the card outside the perimeter of the playing surface. And the act of placing includes avoiding a formed polygon. The method further comprises ending the strategy card game when one of the players is first to run out of point markers. The method yet further comprises ending the strategy card game when there are no more cards available to pick. The method as yet further comprises ending the strategy card game when there is no more playing surface on which to place cards.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, where.

DETAILED DESCRIPTION OF THE PREFERRED EMBODIMENT

Various embodiments of the present invention provide a card game that allows two or more players to participate. Any suitable playing surface can be used (such as vertical or horizontal) as long as the playing surface formed from a magnetic element, such as iron. At the conclusion of the game, an esthetic, random image is created by the plurality of played cards.

Figure 1A:
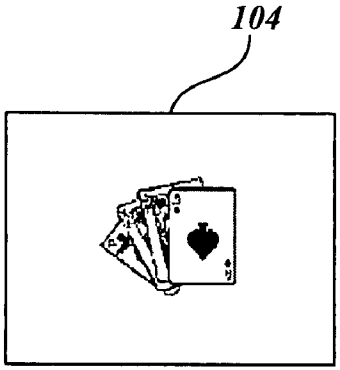
FIGS. 1A, 1B illustrate a set of conventional game cards and a piece of a conventional puzzle.
Figure 1B:
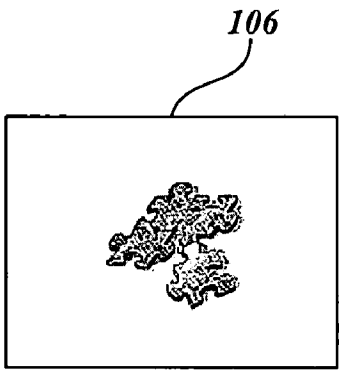
Figure 2A:
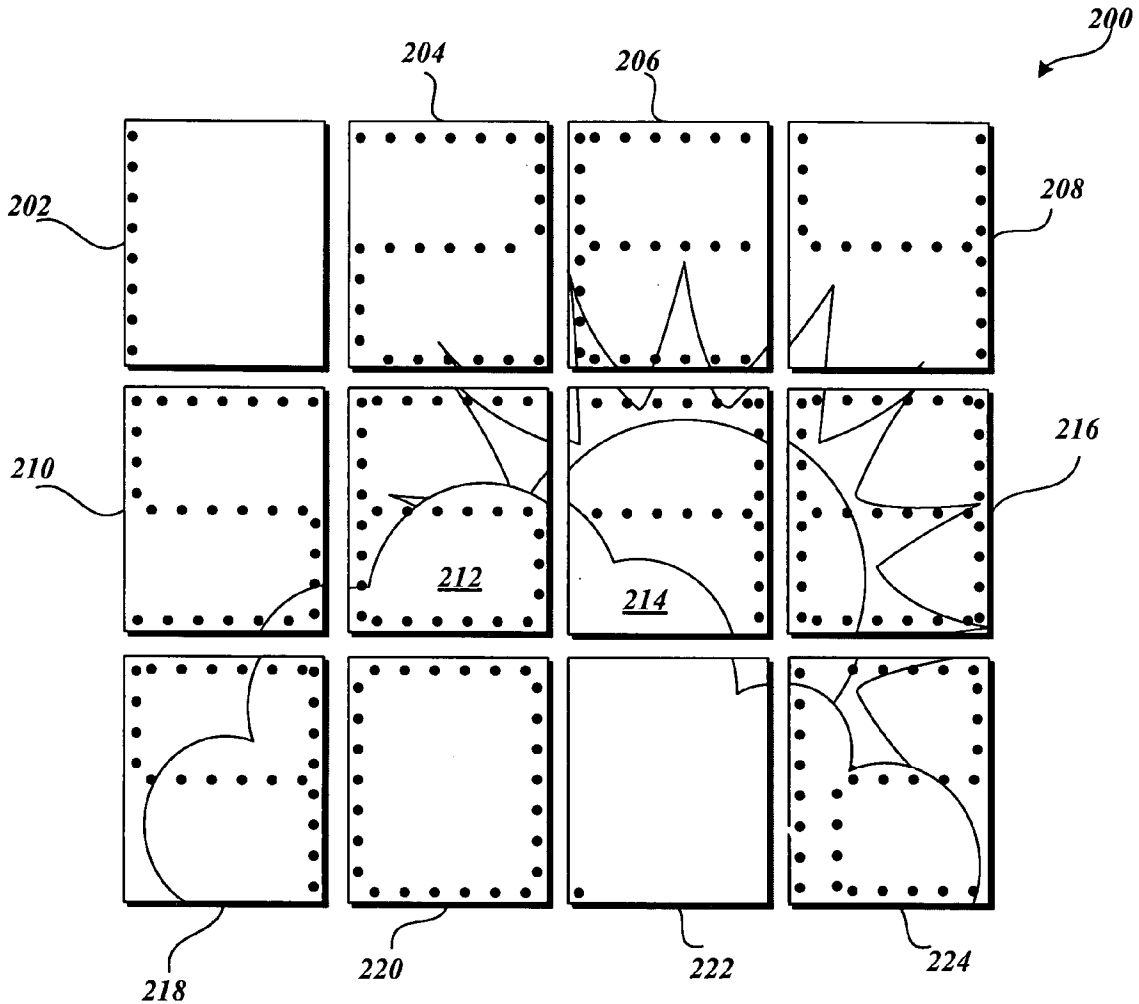
FIG. 2A illustrates a set of game cards, in accordance with one embodiment of the present invention.

A portion of a game kit 200 includes a number of cards, such as cards 202–228. See FIG. 2A. Each card 202–228 is formed by a top layer and a bottom layer. The top layer has an arbitrary design which is superimposed with dotted-line configurations. The bottom layer is magnetized. Each card 202–228 is one of three types: a play card, a point card, or a blocker card. Cards 202–210, 214, and 224 are play cards. Cards 212, 216, 218, and 220 are point cards. Card 222 is a blocker card. Play cards 202–210, 214, and 224 are superimposed by dotted-line configurations. Play card 202 has a superimposed dotted-line configuration shaped like a numeral 1. A dotted-line configuration shaped like a numeral 2 is superimposed over play card 204. A numeral 3 dottted-line configuration shape superimposes over play card 206. Play card 208 has a superimposed dotted-line configuration that shapes like a numeral 4. A dotted-line configuration shaped like a numeral 5 is superimposed over play card 210. Play card 214 has a superimposed dotted-line configuration that shapes like a numeral 7. A dotted-line configuration in the shape of numeral 12 is superimposed over play card 224. A dotted-line configuration shaped like a numeral 6 is superimposed over point card 212. Point card 216 has a superimposed dotted-line configuration shaped like a numberal 8. A numeral 9 dotted-line configuration shape superimposes over point card 218. A dotted-line configuration shaped like a numeral 0 is superimposed over point card 220. A blocker card 222 has a single dot configuration. These dotted-line configurations for cards 202–224 are for illustrative purposes only and any suitable dotted-line configuration can be used.

Another portion of the game kit 200 includes a playing surface 292 that is preferrably formed from a magnetic element material, such as iron. See FIG. 2B. A third portion of the game kit 200 includes one or more point markers in varying shapes and sizes. A point marker 274 circular in shape is shown in FIG. 2B.

Figure 2B:
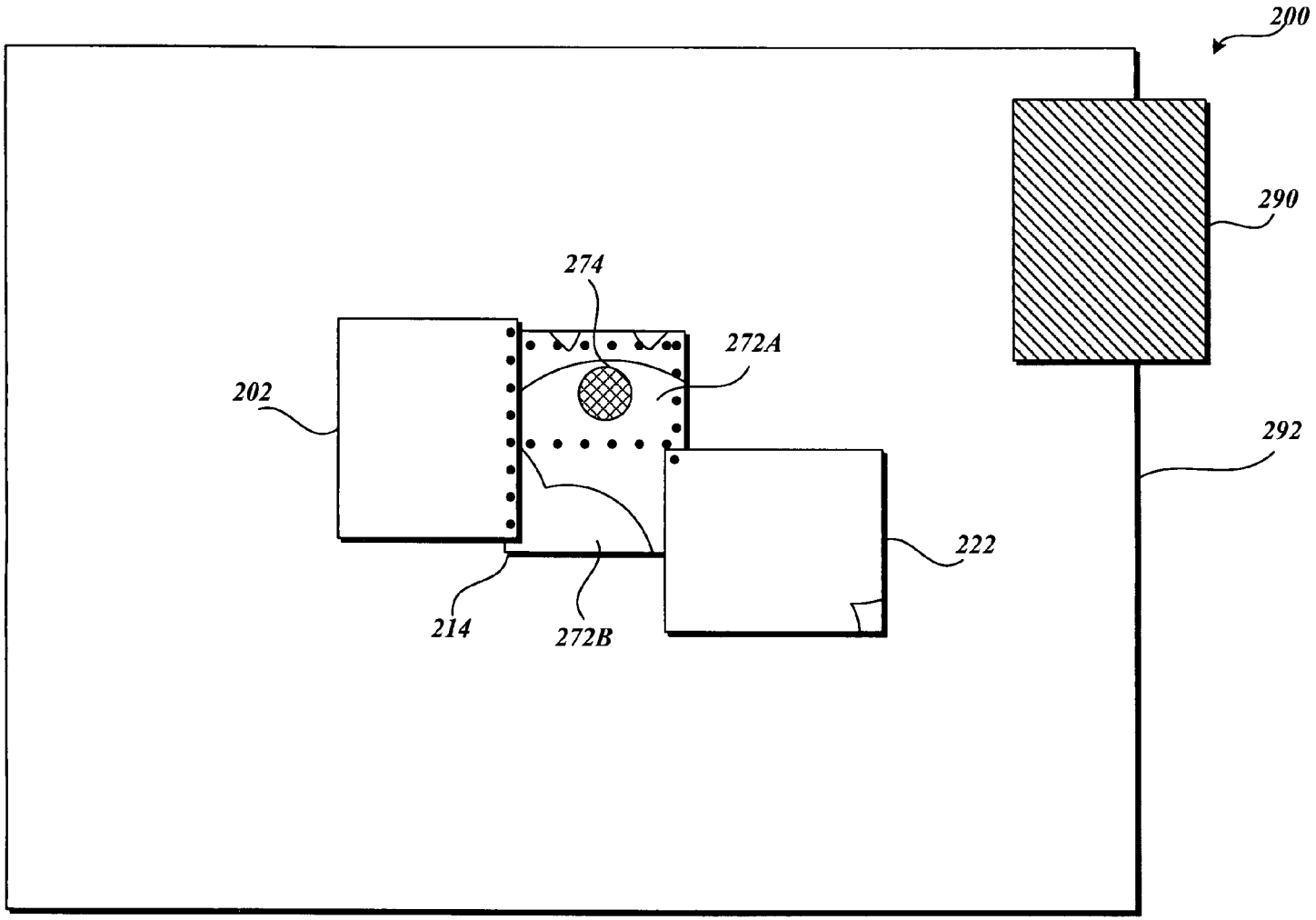
FIG. 2B illustrates a number of game cards in play, in accordance with one embodiment of the present invention.
Figure 3A:
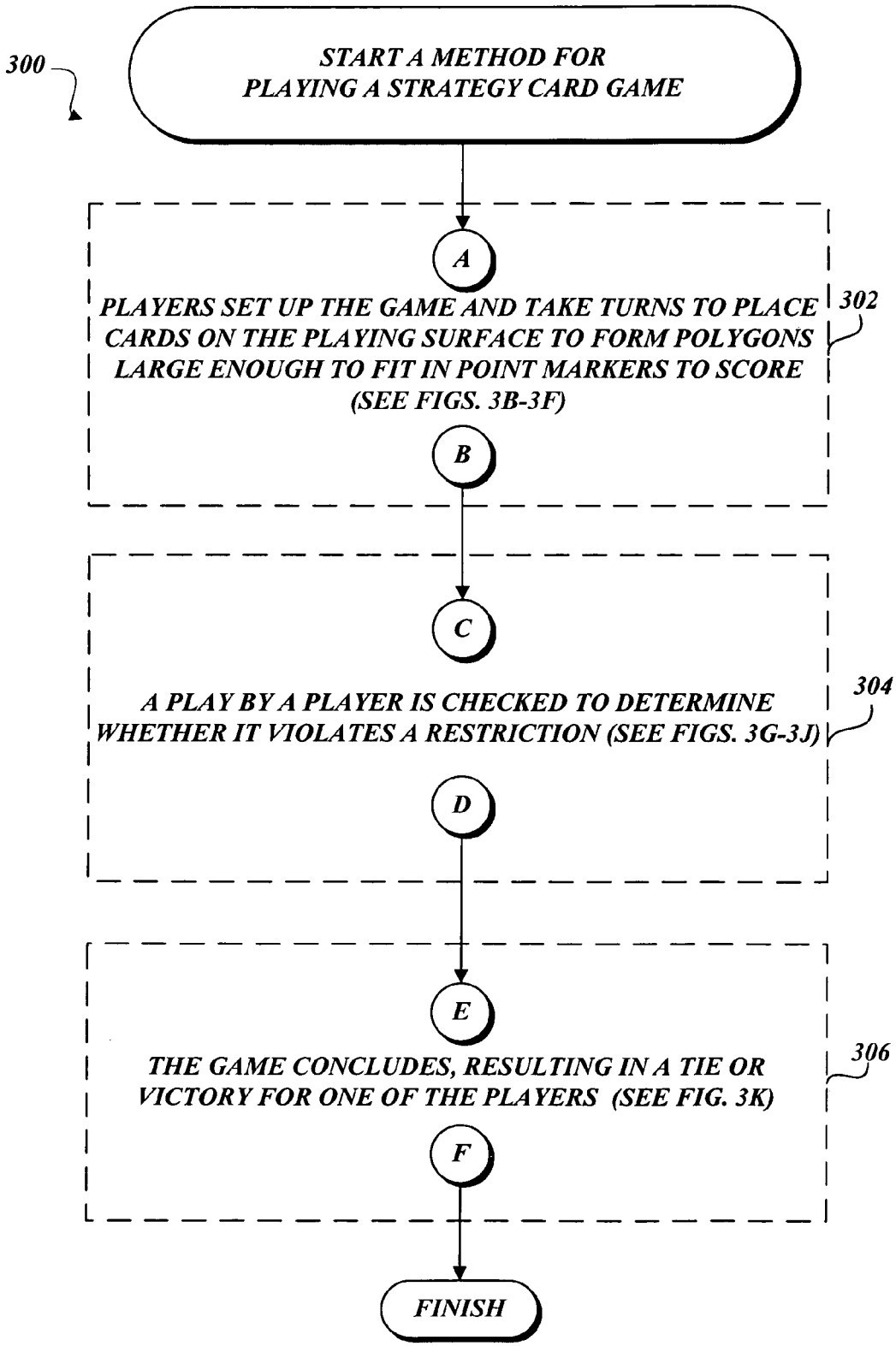
FIGS. 3A–3K are process diagrams illustrating a method of playing a card game, in accordance with one embodiment of the present invention.
Figure 3B:
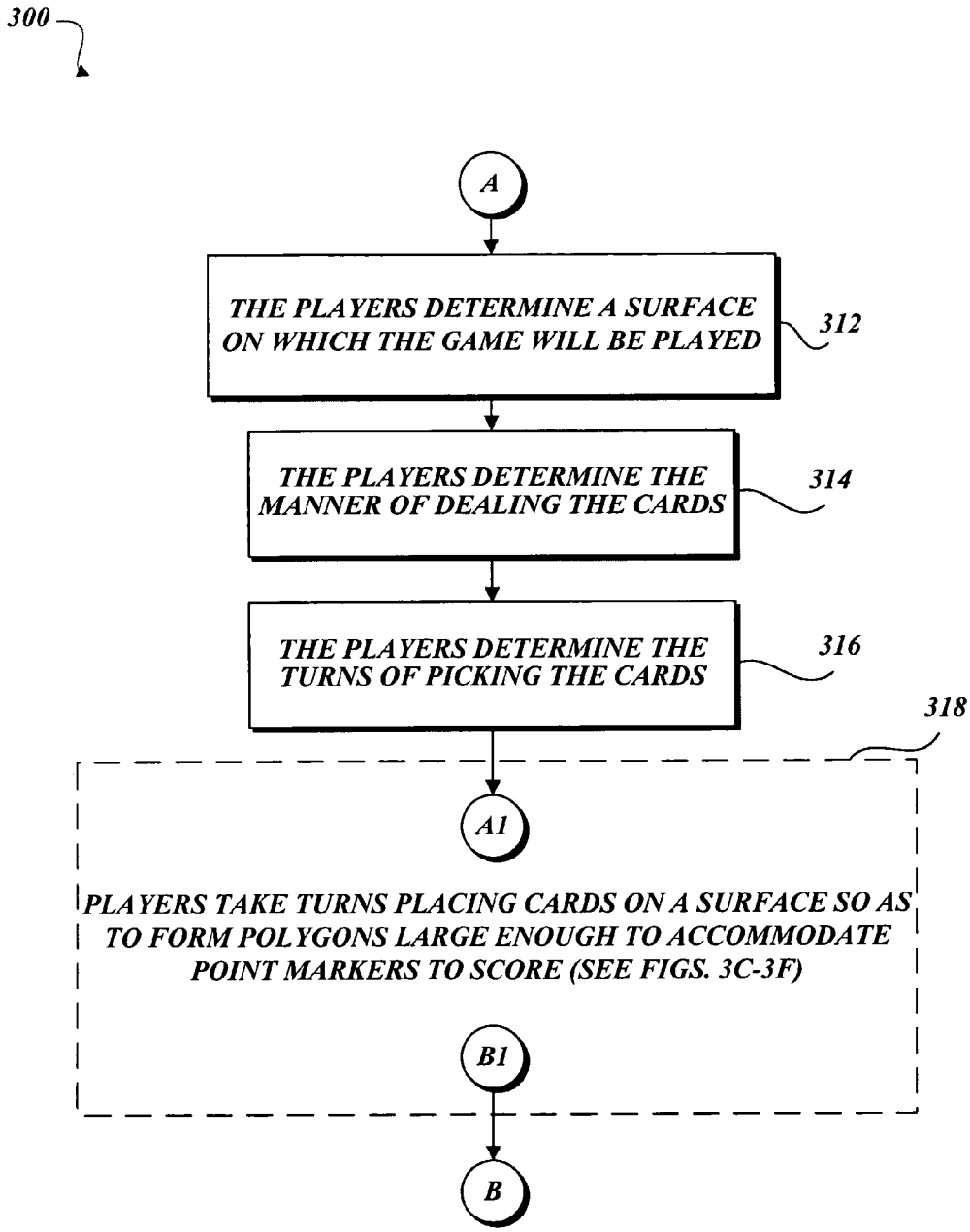
Figure 3C:
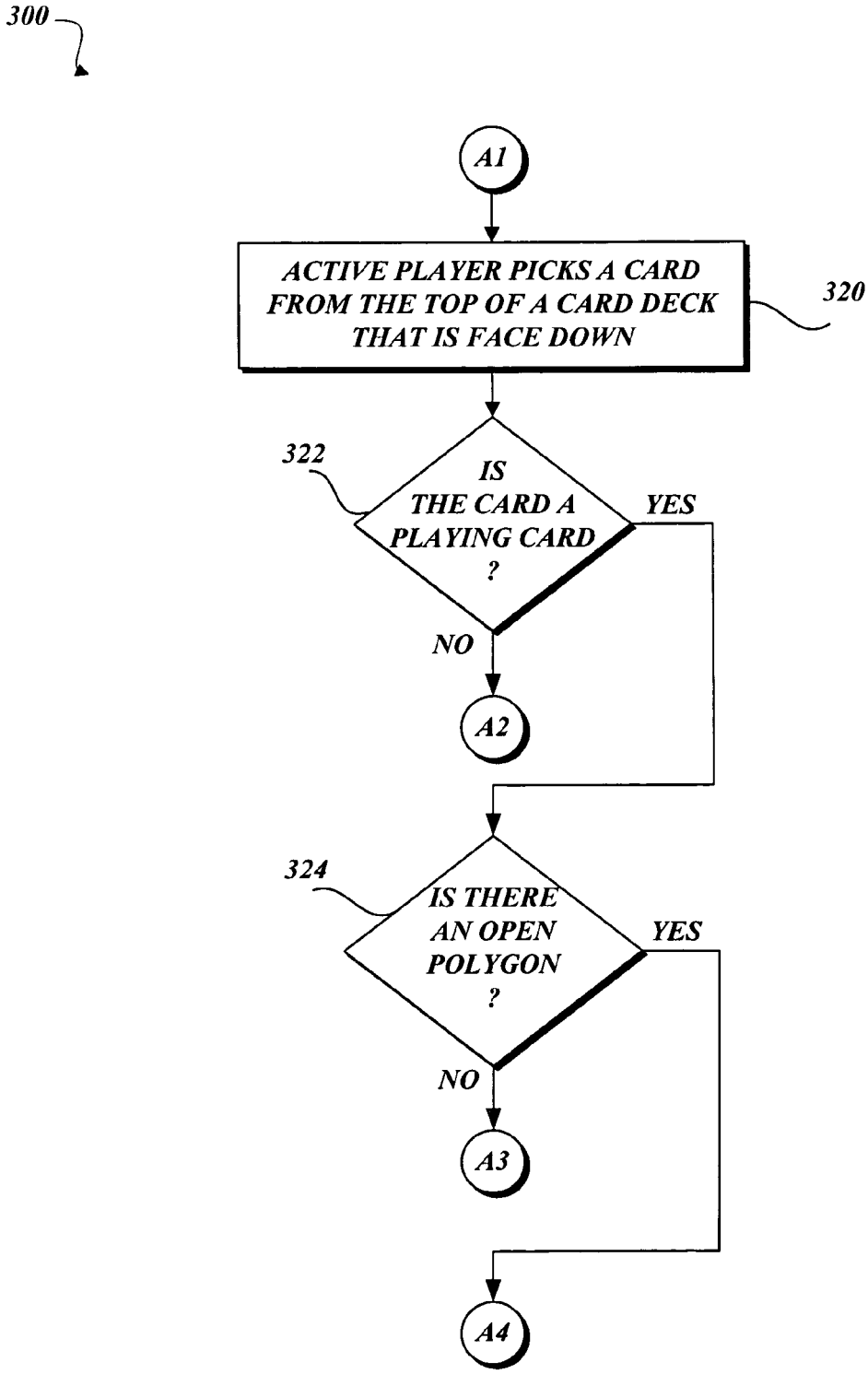
Figure 3D:
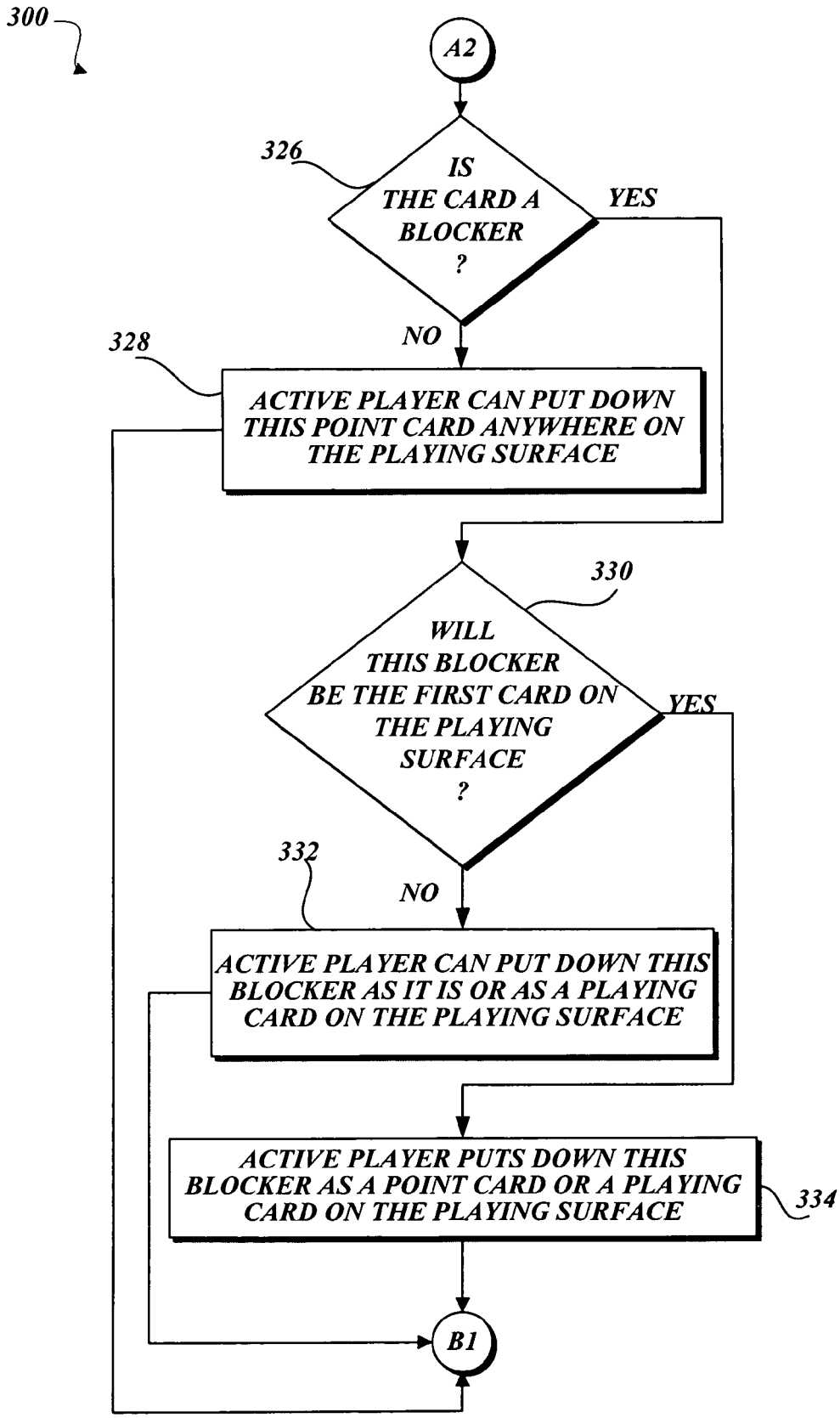
Figure 3E:
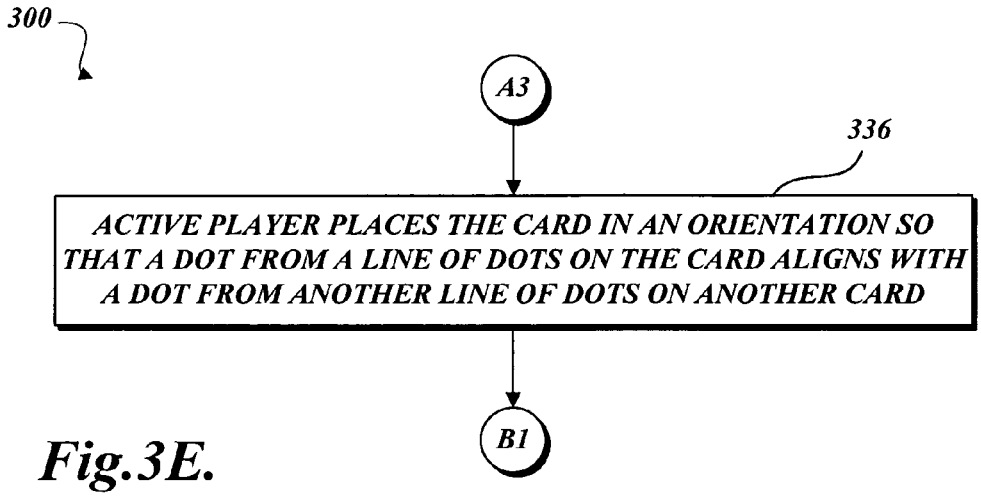
Figure 3F:
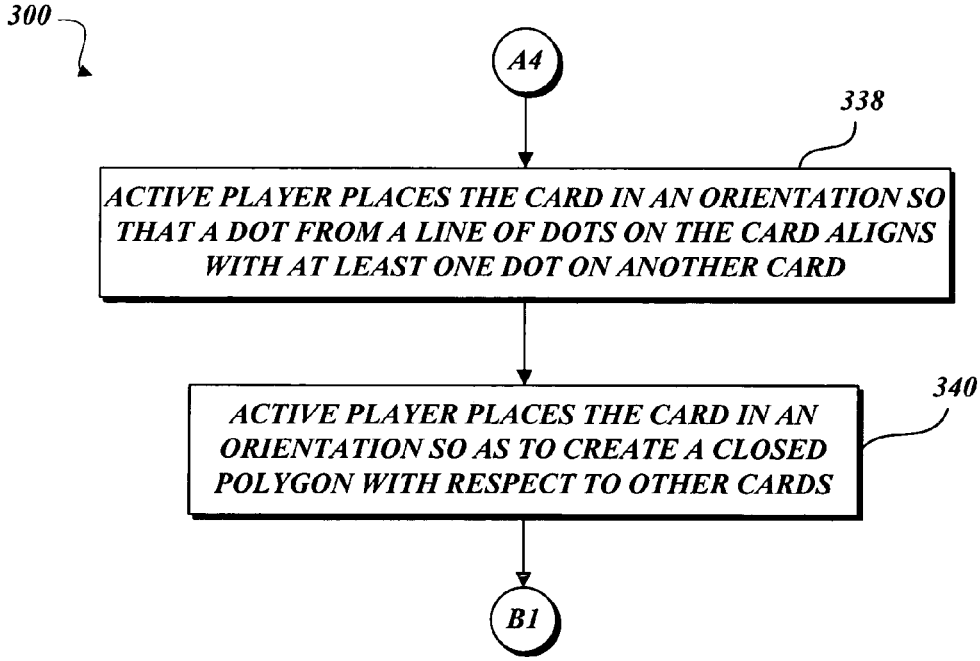
Figure 3G:
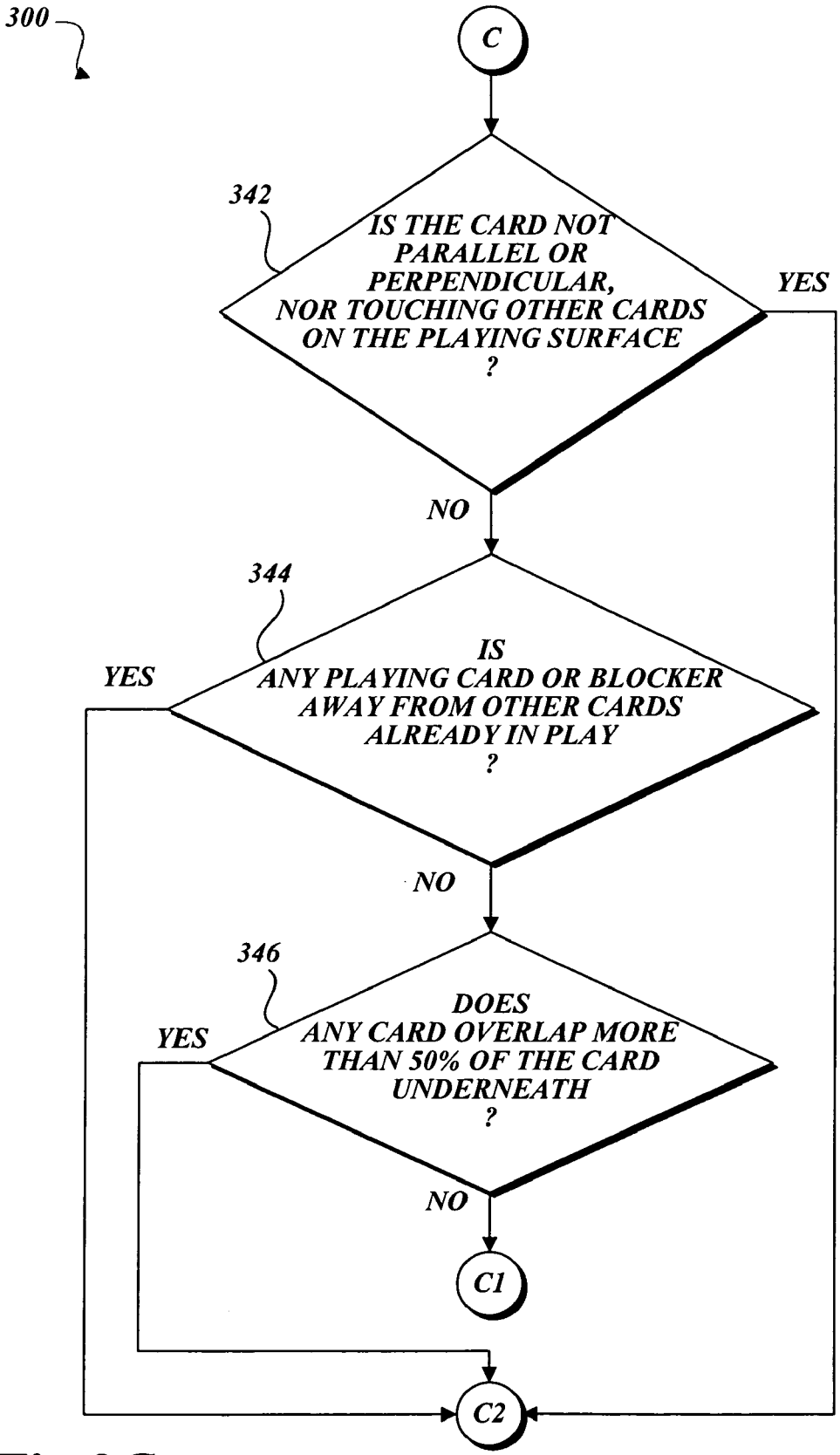
Figure 3H:
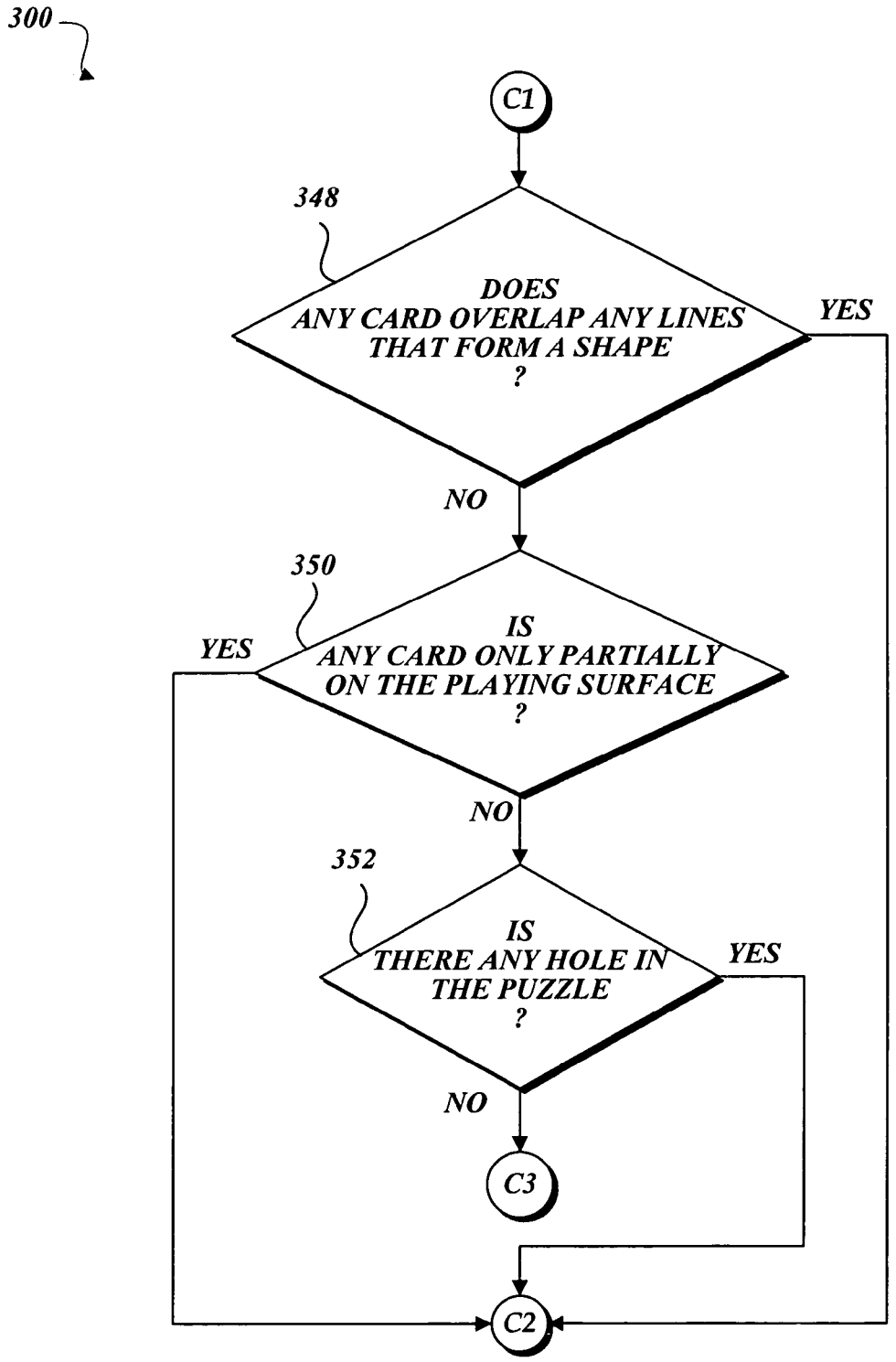
Figure 3I:
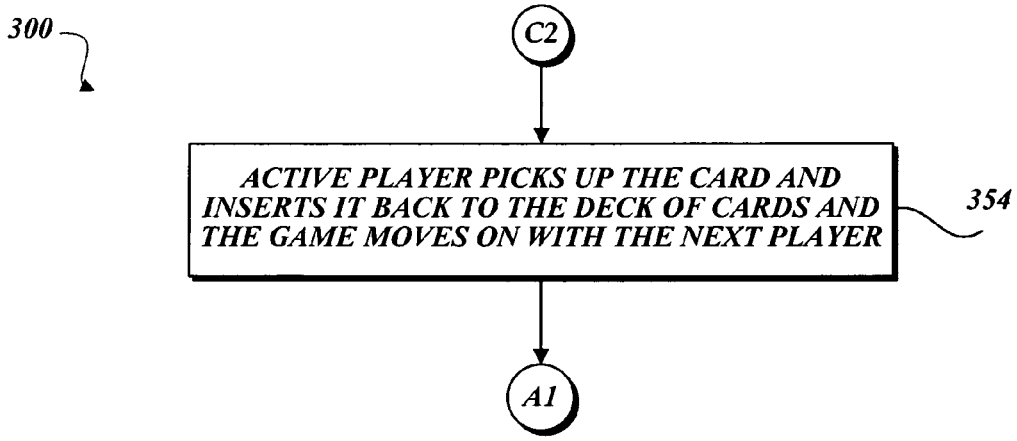
Figure 3J:
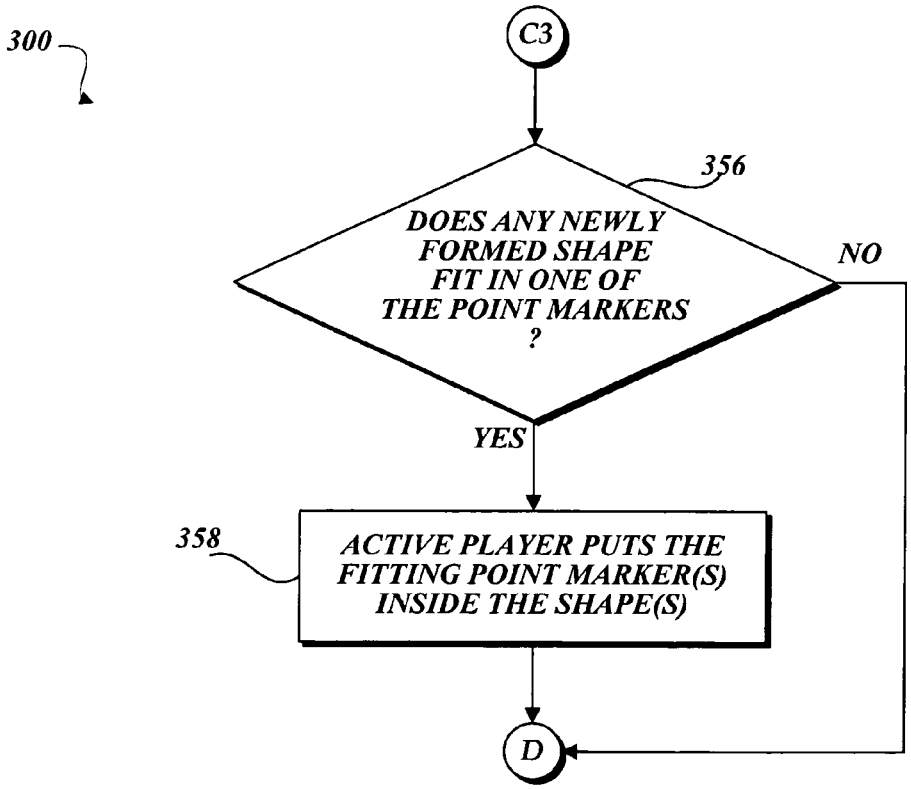
Figure 3K:
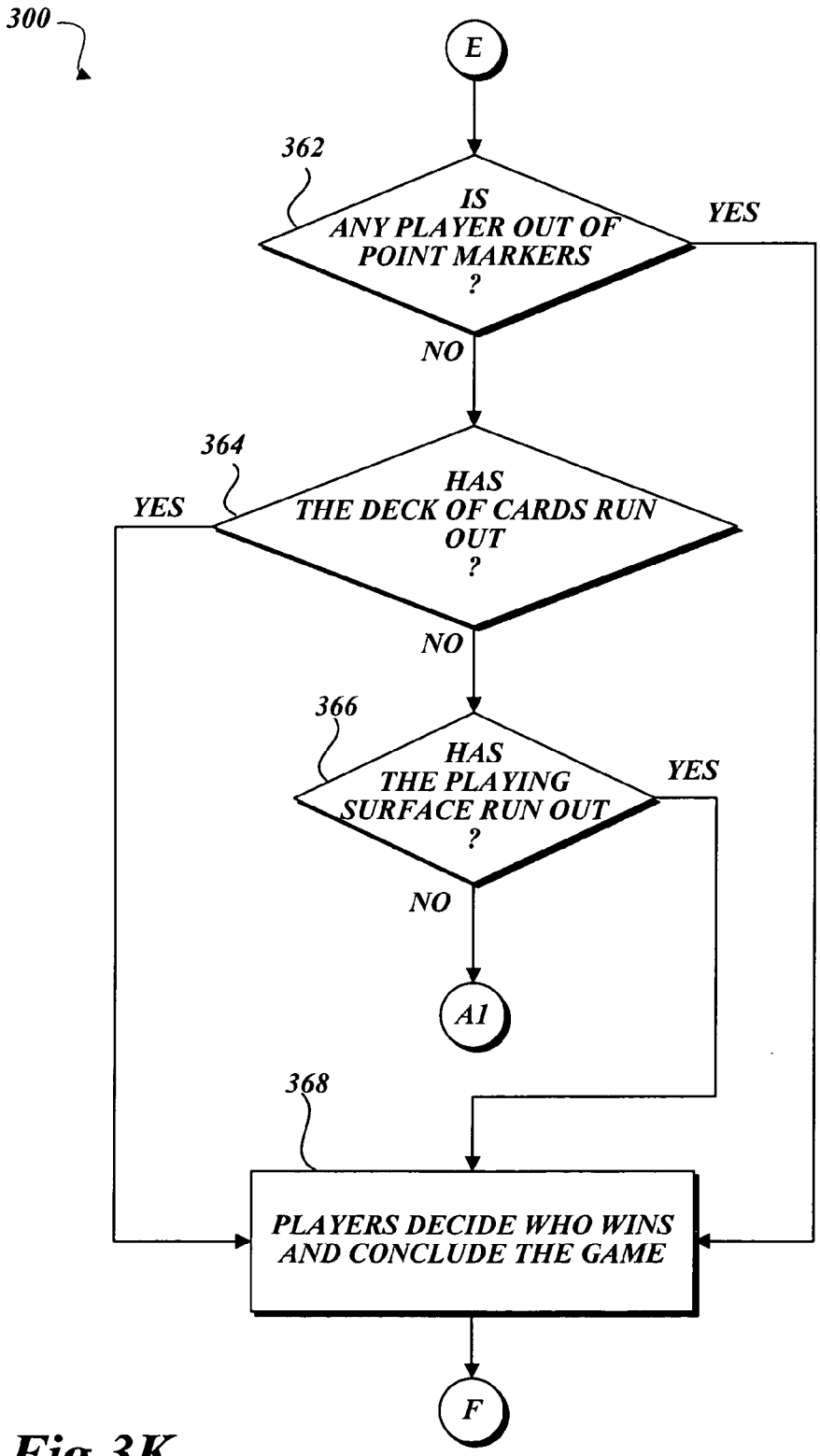

FIG. 2B illustrates a game in play. A deck 290 comprises cards 204–212, 216–220, and 224 that are facing down. Playing card 214 is drawn from the deck 290 and is placed on the playing surface 292 by a first player. A second player draws playing card 202 from the deck 290 and situates the dotted-line configuration of the play card 202 against the play card 214 to form an enclosed polygon 272A and create an open polygon 272B. Once a player forms an enclosed polygon, such a player scores a point by finding a point marker that can fit inside the enclosed polygon. The second player places the point marker 274 inside the enclosed polygon 272A and the play passes next to the first player. The first player draws the blocker card 222 from the deck 290. To prevent the second player from potentially creating another enclosed polygon from the open polygon 272B and score more points, the first player situates the blocker card 222 to line up the single dot on the blocker card 222 and obstruct a portion of the dotted-line configuration of the playing card 214 that form a side of the open polygon 272B. Each blocker card preferably has one dot on the face of the card. To block an opposing player's opportunity to create a shape on his next turn, a player places a blocker card to prevent a configuration that has the likelihood of becoming a shape. This is done in such a way that it breaks up one or more sides of an enclosable polygon and prevents the player's opponents from closing the shape in a single turn.

Each player plays preferably with a set of five point markers that are preferably of different sizes and shapes. The bigger the point marker is, the more points it represents. To score points in the game, players attempt to form polygons large enough to fit one of their five point markers. The playing surface 292 is preferably a magnetically attracting surface. This can be anything from a game board to the side of a refrigerator. There is a rule preference that all cards placed on the playing surface, in unison and individually, cannot in any way exceed the size and shape of the playing surface. This means that plays in the game will not only be influenced by whether there is the availability to create a shape, but also whether or not there is enough playable surface area on which to place a card. Narrow and smaller surfaces, as found on the sides of pick-up trucks and mini-refrigerators, would likely be more challenging to compete on than garage doors and full size refrigerators.

Multiple players can be accommodated by various embodiments of the present invention. As shown in FIG. 2B, the object of the game is for players to earn points by creating enclosed polygons from cards 202–224 that are large enough into which to fit one of the point markers. The player with the most points is the victor at the conclusion of a game.

FIGS. 3A–3K illustrate a method 300 for a strategy card game. From a start block, the method 300 proceeds to a set of method steps 302, defined between a continuation terminal ("terminal A") and an exit terminal ("terminal B"). The set of method steps 302 describes how the players set up the game and take turns to place cards on the playing surface to form polygons large enough into which the point markers will fit.

From terminal A (FIG. 3B), the method 300 proceeds to block 312 where the players choose a playing surface to play the game. See block 312. For example, the players can choose to play on the door of a refrigerator. Next, the players determine the manner of dealing the cards. See block 314. For example, the cards may be dealt by each player picking up a single card, per turn, from a face-down deck of cards. Finally, the players determine the order of their participation in the game. See block 316. For example, the players can flip a coin to see who goes first. The winner of each coin flip will go first.

Then, the method 300 proceeds to a set of method steps 318, defined between a continuation terminal ("terminal A1") and an exit terminal ("terminal B1"). The set of method steps 318 describes how the players take turns to place cards on the playing surface to form polygons large enough to fit the point markers in.

From terminal Al (FIG. 3C), the method 300 proceeds to block 320, where the active player (a player is an active player when it is his or her turn to pick and place a card) picks a card from the top of a card deck that is face down. See block 320. Then the method 300 proceeds to a test to determine whether the card picked is a play card. See decision block 322. If the answer to the test is NO, the method 300 proceeds to terminal A2. If the answer to the test is YES, the method 300 proceeds to another test to determine whether there is an open polygon on the playing surface. See decision block 324. If the answer is NO, the method 300 proceeds to terminal A3. If the answer is YES, the method 300 proceeds to terminal A4.

From terminal A2 (FIG. 3D), the method 300 proceeds to test if the card picked is a blocker card. See decision block 326. If the answer is NO, then this card is a point card, and the active player may place this point card anywhere on the playing surface. See block 328. The method 300 then proceeds to terminal B1.

If the answer to the test in decision block 326 is YES, then this card is a blocker card. The method 300 then proceeds to another test to determine whether the blocker card will be the first card on the playing surface. See decision block 330. If the answer is NO, the active player may use this card as a blocker card or as a play card on the playing surface. See block 332. The method 300 then proceeds to terminal B1. If the answer is YES, the active player may use the blocker card as a point card or a play card on the playing surface. See block 334. The method 300 then proceeds to terminal B1.

From terminal A3 (FIG. 3E), the active player places the card in an orientation such that a dot from a line of dots on the card aligns with a dot from another line of dots on another card. See block 336. The method 300 then proceeds to terminal B1.

From terminal A4 (FIG. 3F), the active player places the card in an orientation such that a dot from a line of dots on the card aligns with a dot from another line of dots on another card. See block 338. The active player also places the card in such an orientation with other cards as to create a closed polygon. See block 340. The method 300 then proceeds to terminal B1. From terminal B1, the method 300 enters terminal B.

From terminal B, the method 300 proceeds to a set of method steps 304, defined between a continuation terminal ("terminal C") and an exit terminal ("terminal D"). The set of method steps 304 describes the restrictions of the game that define valid and invalid placements of cards.

From terminal C (FIG. 3G), the method 300 proceeds to a series of tests. The first test is to determine whether the card is not placed parallel or perpendicular, nor touching other cards on the playing surface. See decision block 342. If the answer is NO, the method 300 proceeds to the second test to determine whether the card, if a blocker card or a play card, is placed away from other cards already in play. See decision block 344. If the answer is NO, the method 300 proceeds to the third test to determine whether any card overlaps more than 50% of the card underneath it. See decision block 346. If the answer is NO, the method 300 proceeds to terminal C1. If the answer to any of these tests is YES, the method 300 proceeds to terminal C2.

From terminal C1 (FIG. 3H), the method 300 proceeds to another series of tests. The first test is to determine whether any card overlaps any lines that form a polygon. See decision block 348. If the answer is NO, the method 300 proceeds to the second test to determine whether any card is only partially on the playing surface. See decision block 350. If the answer is NO, the method 300 proceeds to the third test to determine whether there is any hole in the puzzle. Undesired holes occur when the cards are placed in such a way that sections of the playing surface show through the puzzle. See decision block 352. If the answer is NO, the method 300 proceeds to terminal C3. If the answer from any of these tests is YES, the method 300 proceeds to terminal C2.

From terminal C2 (FIG. 3I), the method 300 proceeds to block 354, where the active player corrects the mistake by picking up the most recently placed card, inserting it back into the deck of cards and passing the game to the next player in line. See block 354. The method 300 then loops back to terminal A1 where the next player starts his or her turn by picking a card from the deck of cards.

From terminal C3 (FIG. 3J), the method 300 proceeds to test whether any newly formed shape(s) may fit the available point markers. See decision block 356. If the answer to the test is YES, the active player places the proper point marker in the shape. See block 358. The method 300 then proceeds to terminal D. If the answer is NO, the method 300 proceeds directly to terminal D.

From terminal D, the method 300 proceeds to a set of method steps 306, defined between a continuation terminal ("terminal E") and an exit terminal ("terminal F"). The set of method steps 306 describes the process where the results of the game are determined and the game ends.

From terminal E (FIG. 3K), the method 300 proceeds to decide whether any player is out of point markers. See decision block 362. If the answer is YES, that player is the winner, and the game concludes. See block 368. If the answer is NO, the method 300 proceeds to decide whether the deck of cards or the playing surface has run out. See decision blocks 364 and 366. If the answer to any of the tests in decision blocks 364 and 366 is YES, the game ends, and the player who has the highest points is the winner. There can be a tie if two or more players have same points. See block 368. If the answers to all the three tests in decision blocks 362, 364, and 366 are NO, the game moves on with the next player. The method 300 proceeds to terminal A1 where the next player picks a card to play the game. Various embodiments of the present invention can be implemented also as a video game or a software game that can be played on a computer or a cellular phone.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method of playing a strategy card game wherein points are awarded for forming closed polygons, comprising:

selecting a first card from a set of cards that is selected from a group consisting of a play card, a point card, and a blocker card, each card having a top layer and a bottom layer, the top layer having a design superimposed by one or more lines that form a pattern, the bottom layer being magnetized, the pattern on each play card forming one or more open polygons, the pattern on each point card forming one or more closed polygons, and the pattern on each blocker card forming only a single dot with no polygons;

placing the first card on a playing surface formed from a magnetic element;

selecting a second card selected from the set of cards; and placing the second card against the first card on the playing surface by situating the pattern of the first card against the pattern of the second card wherein the one or more lines forming the pattern on the first card is adjacent to the one or more lines forming the pattern on the second card to form a closed polygon that was not formed before the cards were placed against each other or situating the pattern of the first card against the pattern of the second card to extend the pattern of the second card to form an open polygon, automatic points being awarded if the second card is a point card, or placing a second card if it is a blocker card, next to the first card if the first card is a point card or a play card, the single dot on the blocker card breaking up one or more lines on the sides of the first card preventing an opposing player from placing another play card or point card next to the first card to form a closed polygon, and if the second card is a blocker card, the second card is placed so as not to overlap the first card by 50%.

2. The method of claim 1, further comprising selecting a point marker from a group of point markers having varying sizes, the point marker having a size that can be placed into the closed polygon without touching the patterns of the first card and the second card, the size of the point marker being indicative of a number of points acquired to win the strategy card game.

3. The method of claim 1, wherein the act of placing the second card includes placing the card in a position selected from a group consisting of parallel and perpendicular so as to touch the first card, the act of placing the second card including avoiding overlapping a line that is a part of the closed polygon, the act of placing the second card including inhibiting the placement of the second card to form a void showing through from any playing surface, the act of placing the card including refraining from placing the card outside the perimeter of the playing surface, and the act of placing including avoiding a formed polygon.

4. The method of claim 1, further comprising assigning point markers to players of the strategy card game to mark closed polygons formed from repeating the act of placing to score points, and ending the strategy card game when one of the players is first to run out of point markers.

5. The method of claim 4, further comprising ending the strategy card game when there are no more cards available to select from the set of cards.

6. The method of claim 4, wherein the playing surface includes a surface area and wherein the method further ends the strategy card game when there is no more surface area on which to place cards.

* * * * *